US008316783B2

(12) United States Patent
Lankinen

(10) Patent No.: US 8,316,783 B2
(45) Date of Patent: Nov. 27, 2012

(54) SEPARATOR CONSTRUCTION OF A FLUIDIZED BED BOILER

(75) Inventor: Pentti Lankinen, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 844 days.

(21) Appl. No.: 12/300,896

(22) PCT Filed: May 16, 2007

(86) PCT No.: PCT/FI2007/050280

§ 371 (c)(1),
(2), (4) Date: May 7, 2009

(87) PCT Pub. No.: WO2007/135238

PCT Pub. Date: Nov. 29, 2007

(65) Prior Publication Data

US 2010/0024694 A1 Feb. 4, 2010

(30) Foreign Application Priority Data

May 19, 2006 (FI) ..... 20060492

(51) Int. Cl.
*F23J 3/00* (2006.01)
*F22B 37/24* (2006.01)

(52) U.S. Cl. ..... 110/216; 52/39; 248/61; 248/317

(58) Field of Classification Search ..... 110/216, 110/245; 122/4 D, 450, 493, 510
See application file for complete search history.

(56) References Cited

U.S. PATENT DOCUMENTS

| | | | | |
|---|---|---|---|---|
| 5,281,398 | A | 1/1994 | Hyppanen et al. | 422/147 |
| 5,329,892 | A | 7/1994 | Svendsen | 122/510 |
| 5,489,166 | A | 2/1996 | Schmit | 406/137 |
| 6,039,008 | A * | 3/2000 | Anderson et al. | 122/510 |
| 6,305,330 | B1 * | 10/2001 | Darling | 122/510 |
| 6,323,442 | B1 * | 11/2001 | Jones | 122/379 |
| 7,240,640 | B2 * | 7/2007 | Kinnunen | 122/510 |
| 2006/0185624 | A1 | 8/2006 | Kinnunen | 122/510 |

FOREIGN PATENT DOCUMENTS

JP 5-126303 5/1993

(Continued)

OTHER PUBLICATIONS

International Search Report dated Dec. 3, 2007, which was mailed in a Communication dated Dec. 7, 2007, and which issued in corresponding International Application No. PCT/FI2007/050280.

(Continued)

*Primary Examiner* — Kenneth Rinehart
*Assistant Examiner* — David J Laux
(74) *Attorney, Agent, or Firm* — Fitzpatrick, Cella, Harper & Scinto

(57) ABSTRACT

A separator construction, connectable to a fluidized bed boiler having a furnace, for circulating bed material and returning the material to the furnace. The separator construction includes walls, a ceiling, an inlet conduit, an outlet conduit in flow communication with a flue gas channel located above the separator, and a suspending device connecting the separator to a supporting structure in a building housing the boiler. The suspending device is formed of a frame arranged between the flue gas channel and the separator in connection with an upper circumference of the wall of the separator, and hanger rods or wires connecting the frame directly to the supporting structure.

13 Claims, 3 Drawing Sheets

FOREIGN PATENT DOCUMENTS

| | | | |
|---|---|---|---|
| RU | 2 134 146 | C1 | 8/1999 |
| RU | 2 235 943 | C2 | 4/2004 |
| WO | WO 91/19940 | | 12/1991 |
| WO | 96/28237 | | 9/1996 |
| WO | WO 01/65175 | A1 | 9/2001 |
| WO | WO 2004/048849 | A1 | 6/2004 |

OTHER PUBLICATIONS

Written Opinion of the International Searching Authority mailed Dec. 7, 2007, issued in International Application No. PCT/FI2007/050280.

Russian Official Action dated Apr. 2, 2010, issued in corresponding Russian patent application No. 2008150320/12(066032).

* cited by examiner

SEPARATOR CONSTRUCTION OF A FLUIDIZED BED BOILER

This application is a U.S. national stage application of PCT International Application No. PCT/FI2007/050280, filed May 16, 2007, and published as PCT Publication No. WO 2007/135238 A2, and which claims priority from Finnish patent application number 20060492, filed May 19, 2006.

FIELD OF THE INVENTION

The present invention relates to a separator construction of a fluidized bed boiler, such as one utilized for generating power. The invention has application to a fluidized bed boiler, generally comprising an actual furnace, and apparatuses for treating flue gases, as well as apparatuses for circulating the bed material and returning the material to the furnace. The invention especially relates to suspending of the separator to be used in connection with such a boiler for generating power.

BACKGROUND OF THE INVENTION

The fluidized bed boilers related to the present invention and, more accurately, the components thereof, are equipped with so-called water/steam tube walls, which literally consist of parallel water/steam tubes and plate-like fins between the tubes. The purpose of the water or steam circulating in the water/steam tubes is, depending on the application, mainly to recover heat generated in combustion, or to maintain the wall temperature within reasonable values. As for their strength, such water/steam tube walls are, in view of their size, relatively weak, so they cannot be used to bear directly the stresses caused by the weight of the boiler or of the components thereof, the pressure of the combustion space or thermal expansion, perhaps notwithstanding the direction of the tubes, but, for example, different beam structures are used to support the boiler and different structural parts thereof.

Mainly due to thermal expansion, large fluidized bed boilers, with all of their structural elements, are suspended to hang from the supporting structures of a building housing the boiler. In other words, both the furnace and the separators, removing solid material from the flue gases and attached thereto, have conventionally been mounted by means of hanger rods or wires to the supporting structures of the boiler building. More accurately, in constructions in accordance with the prior art, the furnace has been suspended, in the manner described above, directly to the supporting structures, but mainly, two methods have been used in supporting the separators, depending on how the separator and the flue gas channel passing the flue gases forward therein are arranged relative to each other. An arrangement used more often is to provide each separator with a flue gas channel of its own leading, when viewed from the direction of the furnace, away from the separator. In this case, the separator can be suspended to hang directly from its walls to primary steel structures above the separator. This has been generally realized by arranging hanger rods to the circumference of the separator at intervals of 400 mm, which results in using fifteen to twenty-five hanger rods, naturally depending on the size of the separator. Another method used, especially in large fluidized bed boilers to arrange a flue gas channel in communication with a separator, is, first of all, to arrange separators on opposite sides of the furnace and to arrange a common flue gas channel for the separators to both sides of the furnace. The flue gas channel is naturally situated above the separators. The separators of this arrangement are suspended to the supporting structures by means of the flue gas channel located above them. In principle, the structure is quite applicable. However, with the increase in the size of the power boilers and, at the same time, of the separators, and with the change in their shape, a number of problems have arisen.

First of all, the separators typically used with the fluidized bed boilers are vortex separators in their operational principle, and, traditionally, they have been circular in their cross section. During the last decade, the shape of these separators started to change to quadrate, whereby their mounting to the flue gas channel became easier. There, it was possible to hang the separators either (1) from all sides to the supporting structure above, in other words, to a so-called primary steel structure by means of hanger rods, or, (2) if the separator was first assembled to the flue gas channel, it was possible to use the whole wall of the flue gas channel as a supporting line. Recently, the cross-sectional shape of the separators has become, to a certain extent, rounder, and octagonal separators have become really popular in the market. With this shape, especially with large separators, it is no longer possible to support the separator to the primary steel structure, nor to the bottom of the flue gas channel. When supporting the separator directly to the primary steel structure, the problem will be that there are a number of walls that are in angular position relative to the primary steel structure, lacking a beam above in the primary steel structure, and thus, a place where to hang the separator.

A fact in practice in joining the separators to the flue gas channel, which, in fact, has already been referred to above, is that it is not possible to arrange the bottom of the flue gas channel to support heavy separators, but the only possible supporting areas in the flue gas channel are the vertical sidewalls thereof. It has been noted, however, that large, not right-angled separators do not have enough load carrying areas (lines) between the circumference of the separator and the wall line of the flue gas channel. In practice, this means that, for example, one third or one fourth of the circumferential length of the separator (depending on whether the separator is hexagonal or octagonal) supports the weight of the whole separator and the sand and ash therein, which, in turn, leads to too heavy of local stresses. Exactly in the same way, when the separators change to non-rectangular, only part of the sidewalls of the flue gas channel directly bears the weight of the separators. Theoretically, with hexagonal separators, about 50% of the length of the sidewall of the flue gas channel in maximum, and with octagonal separators, only about 40% of the length of the sidewall of the flu gas channel, bears the load directly.

Secondly, since large boilers, practically speaking, always have separators on both sides of the furnace, the flue gas cleaned by the separators should be taken from the separators via as short a route as possible to the heat recovery section of the fluidized bed boiler, and to minimize the construction costs and the pressure losses. On the one hand, this means that the heat recovery section must be arranged as an extension of the furnace on one of its two sides left free and, on the other hand, that the flue gases from both sides of the furnace must be brought to the heat recovery section via as short a route as possible. The result of this is that the flue gas channels must be brought above the separators to the end of the separator bank, and drawn further to the heat recovery section.

It has been noted that one of the problems with this arrangement is that the maximum width of the flue gas channel with the present separator supporting methods may be equal to the diameter of the separator. In some arrangements, even a smaller width of the flue gas channel has been used, but it has proved especially problematic, because a fact is that the cross section of the flue gas channel has to be large enough, so that the flue gases can flow without any substantial pressure loss in the heat recovery section. In other words, if the width of the flue gas channel is limited, the required cross section must be gained by increasing the height of the channel. This, however, instantly increases the total height of the building. The same problem is to be seen in cases where the width of the flue gas channel is limited to the diameter of the separator, especially, when talking about large boilers, whereby there are a lot of separators on both sides of the furnace. This naturally leads to a need for a large cross-sectional flow area.

Thirdly, it has been impossible to define the weight of the separator, and also the weight of sand and ash therein, when using the constructions in accordance with the prior art, by measuring, because there have always been a large number of hanger rods. They have sometimes been positioned between the flue gas channel and the supporting structures, too, whereby the flue gas channel has, in a way, tied all of the separators to one package.

An additional problem related to a large number of hanger rods is that it has been, in practice, very difficult, if not impossible, to arrange the supporting of the separator in such a way that all hanger rods are subject to the same load. Rather, in conventional suspension, some of the rods carry very little weight, whereas others already yield under the weight.

Thus, it is an object of the invention to arrange the supporting of the separator in such a way that the harmful effects of the above-mentioned problems can be diminished.

SUMMARY OF THE INVENTION

In order to solve the above-identified problems of the prior art, it is a characteristic of the separator construction of a fluidized bed boiler, the structure of which separator comprises separator walls and supporting means to be connected to the supporting structure of the separator up above in the boiler building, that the supporting means are formed of a frame to the upper circumferential edge of the separator wall, and hanger rods or wires attaching the frame to the supporting structures.

Other characterizing features of the separator construction of a fluidized bed reactor in accordance with the invention become evident in the accompanying claims.

In other words, the separator is suspended to hang at the level of the furnace ceiling by means of a separate secondary steel structure. It is possible to design the structure in such a way that the hanger means connected to the separator will be evenly distributed to the outer periphery of the panel structure. Problems noted in structures designed with the conventional supporting method may be solved, for example, in the following way:

- too heavy of local loads may be eliminated, because the suspension may be extended to the entire periphery of the separator;
- the stresses, which the flue gas channel is subjected to due to the weight of the separator and the sand and sand therein, will be eliminated completely, because the separator is supported directly to the primary steel structures;
- no difference in thermal expansion occurs in the supporting level between the furnace and the separator, which facilitates the design of the structures;
- the structure of the flue gas channel above the separator, in other words, the size and shape thereof, can be designed freely;
- the flue gas channel above the separator is supported by means of a secondary steel structure from below;
- the secondary steel structure is supported by means of separate hanger rods;
- it is easy to measure the changing weight (sand, ash) of the separator and the flue gas channel above the separator with the help of the hanger rods, whereby the operating method of the boiler can be changed, if too much sand/ash accumulates to the separator; and
- the supporting steel structures and foundations of the separator and the boiler can be designed for less weight, whereby savings are gained in constructions costs, too.

BRIEF DESCRIPTION OF THE DRAWINGS

A separator construction in accordance with the invention is discussed in more detail below with reference to the accompanying drawings, in which.

DETAILED DESCRIPTION OF THE PREFERRED EMBODIMENTS

Figure 1:
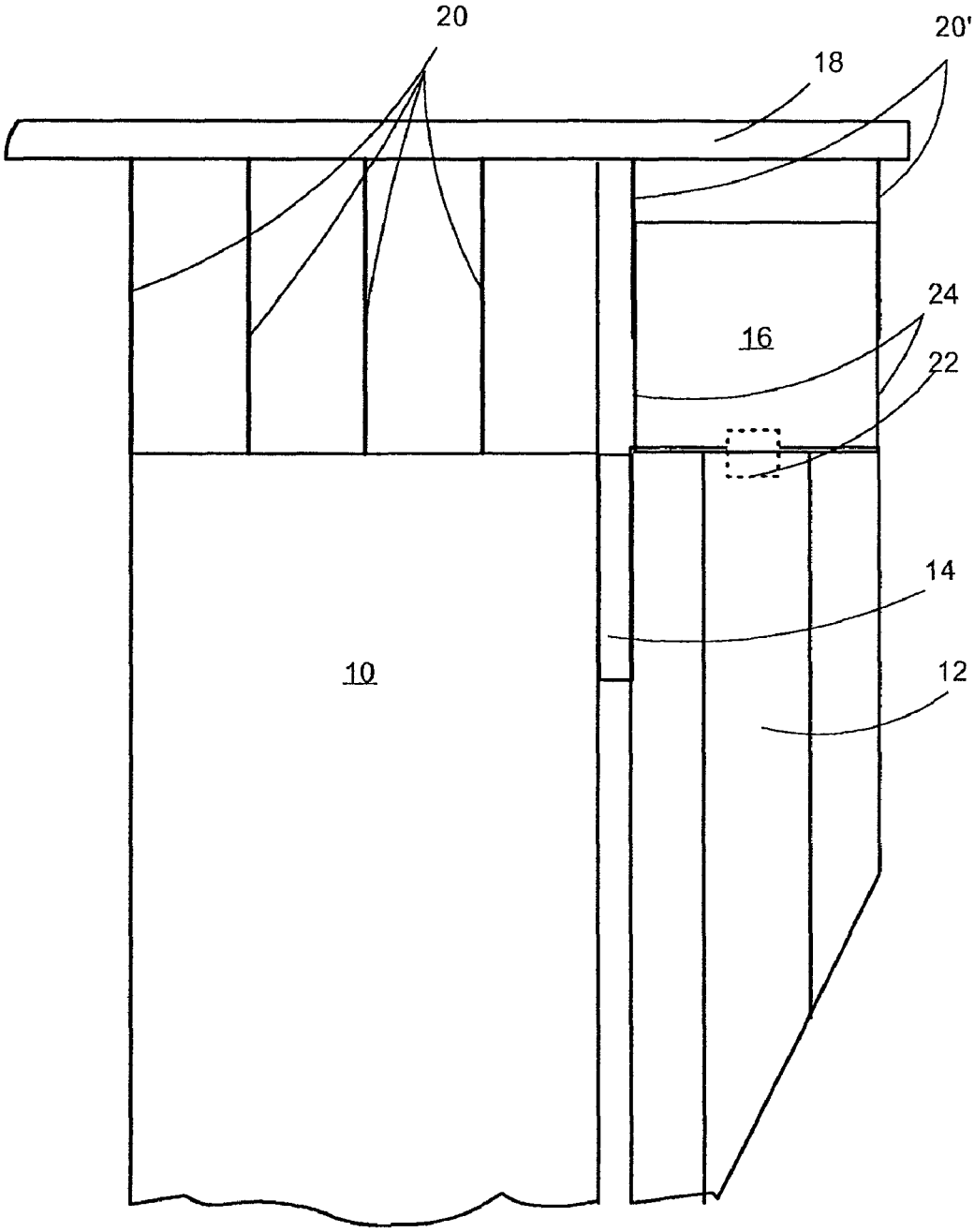
Fig. 1 PRIOR ART
FIG. 1 schematically illustrates a sectional side view of a fluidized bed boiler in accordance with the prior art.

A fluidized bed boiler in accordance with the prior art disclosed in FIG. 1, as a partially sectional view, comprises, as for the parts illustrated in the drawing, a furnace 10, one or more separators 12 located on one side or both sides of the furnace 10, a flue gas conduit 14 connecting them, a flue gas channel 16 located above the separator/separators 12 and a supporting structure 18, i.e., a so-called primary steel structure located in the upper part of the building housing the boiler. Both the furnace 10 and the flue gas channel 16 are suspended with hanger rods or wires 20 from the supporting structure 18. Furthermore, the figure also illustrates a conduit 22 preferably located at the centerline of the separator 12 and leading from the separator 12 to the flue gas channel 16, from which conduit 22 the flue gases, having the solid material separated therefrom in the separator 12, rise to the flue gas channel 16. In the arrangement in accordance with the prior art illustrated in the drawing, the flue gas channel 16 is suspended directly by means of suspending means 20' to the supporting structures 18 above, i.e., to the primary steel structures and the separator/separators 12, in turn, are attached to the flue gas channel 16.

The disclosed apparatus operates in such a way that the fuel supplied to the furnace 10 is combusted and the generated flue gases flow from the furnace 10, together with the ash and the sand that acts as bed material in the furnace 10, through the conduit 14 to the separator 12. The conduit 14 is arranged in the separator 12 substantially tangentially (shown in FIG. 2) in such a way that the mixture of flue gases, ash and sand begins to circulate along the wall of the separator 12. Although the vortex separator used with fluidized bed boilers has traditionally been, first, round, and later on, quadrate, preferably, square, of its cross section, it is already known in the prior art to use octagonal separators in connection with the fluidized bed boilers. When circulating in the separator 12, the heavier material, i.e., ash and, especially, sand, accumulates due to the centrifugal force to the circumference of the separator 12 and begins to flow downwards along the walls of the separator 12, whereby the purified flue gases rise upwards and exit through the conduit 22 at the upper end of the separator 12 to the flue gas channel 16.

Figure 2:
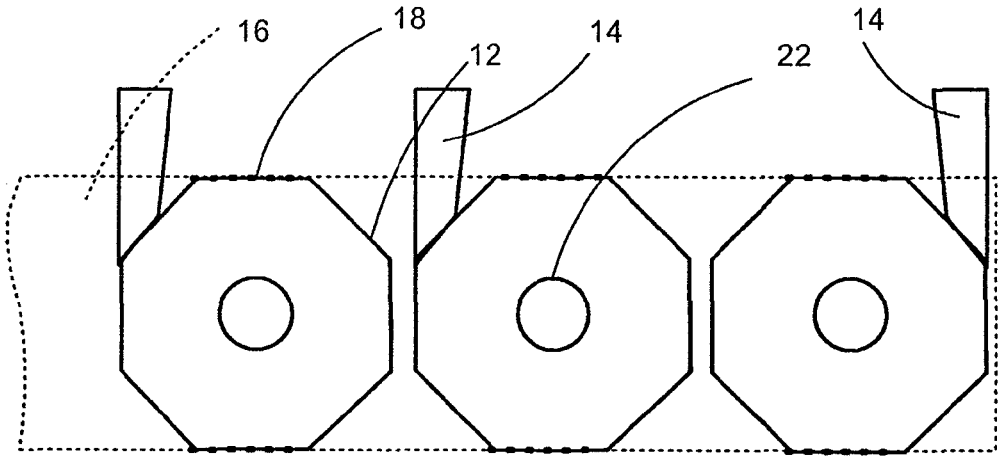
Fig. 2 PRIOR ART
FIG. 2 schematically illustrates a sectional top view of a separator construction in accordance with the prior art.
Figure 3:
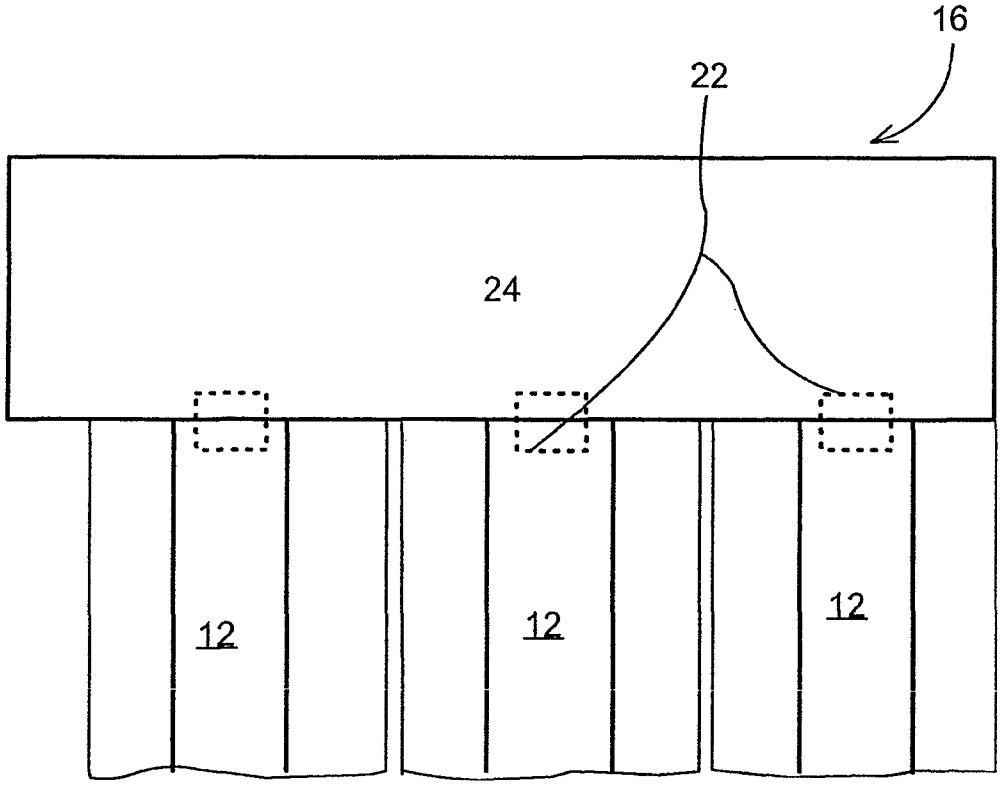
Fig. 3 PRIOR ART
FIG. 3 illustrates a side view of a separator construction in accordance with FIG. 2.

FIGS. 2 and 3 illustrate a prior art arrangement, which is presumed to have three adjacent separators 12 on one side of the furnace 10. The drawings use, as an example, octagonal separators 12. When taking into consideration that, in the arrangement in accordance with the prior art disclosed in FIG. 1, the flue gas channel 16 located above the separators 12 has a width equal to the diameter of the separators 12, it is easy to understand from FIGS. 2 and 3, how the separators 12 are in fact mounted. Because the bottom of the flue gas channel 16, manufactured preferably as a water/steam tube wall, cannot support the weight of the separator 12 and the ash and sand therein, the only parts, to which the entire separator 12 can be supported, are vertical side walls 14 of the flue gas channel 16. FIG. 2 illustrates that the only possibility to attach the separator 12 to the flue gas channel 16 is of its horizontal (in FIG. 2) portions, meaning, in practice, that, on the one hand, only one fourth of the upper circumference of the separator 12 and, on the other hand, only 40% of the length of the side wall of the flue gas channel 16 takes part in the supporting. In other words, both the wall separator 12 and the wall 24 of the flue gas channel 16 are subjected to stresses very unevenly.

Furthermore, since the separators may tend to clog in some conditions, i.e., ash and sand tend to accumulate to the gas lock, or the like, at the lower end thereof, the increase in the total weight of the separator 12 will become a problem when the amount of sand and ash is substantially greater than that in an ordinary running condition. There, the suspending of the separator 12 is subjected to greater stresses than usual. Another problem of the structure in accordance with the prior art, partially related to the above-mentioned problem, is that it would be easier to notice the clogging tendency or even the clogging by monitoring the total weight of the separator 12, but, in practice, this is not possible, because all adjacent separators 12 are connected to the flue gas channel 16 in such a way that they form a uniform separator bank. The flue gas channel 16, in turn, is suspended by means of a great number of hanger rods 20 to the supporting structures, whereby, due to the number of hanger rods 20, it is, in practice, impossible to define at least the weight of a single separator 12. In the same way, in cases where it has been possible to suspend the separator 12 to the primary steel structures directly by means of hanger rods 20, the number of the hanger rods 20 has been so great that, in connection with such, for practical reasons explained earlier, it has not been possible to use any kind of weight measuring arrangements.

Figure 4:
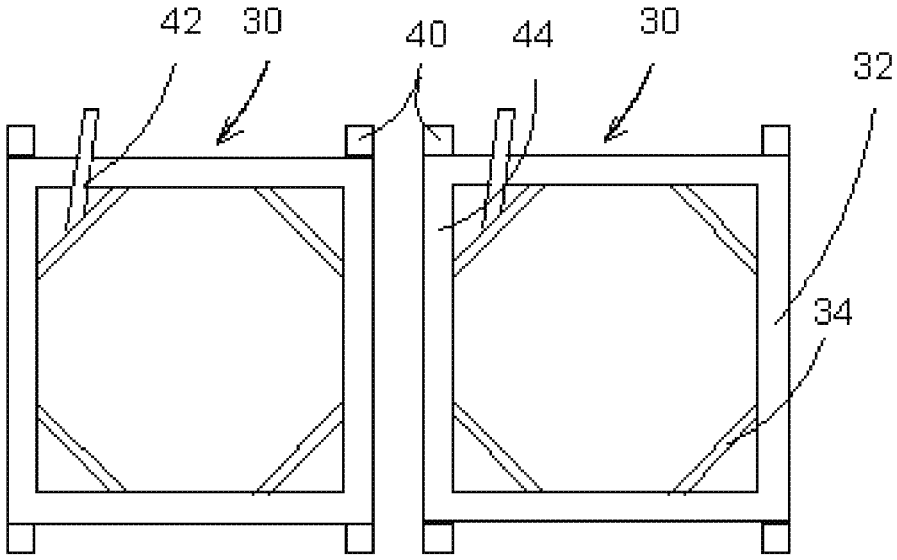
FIG. 4 illustrates a top view of a separator construction in accordance with a preferred embodiment of the invention.
Figure 5:
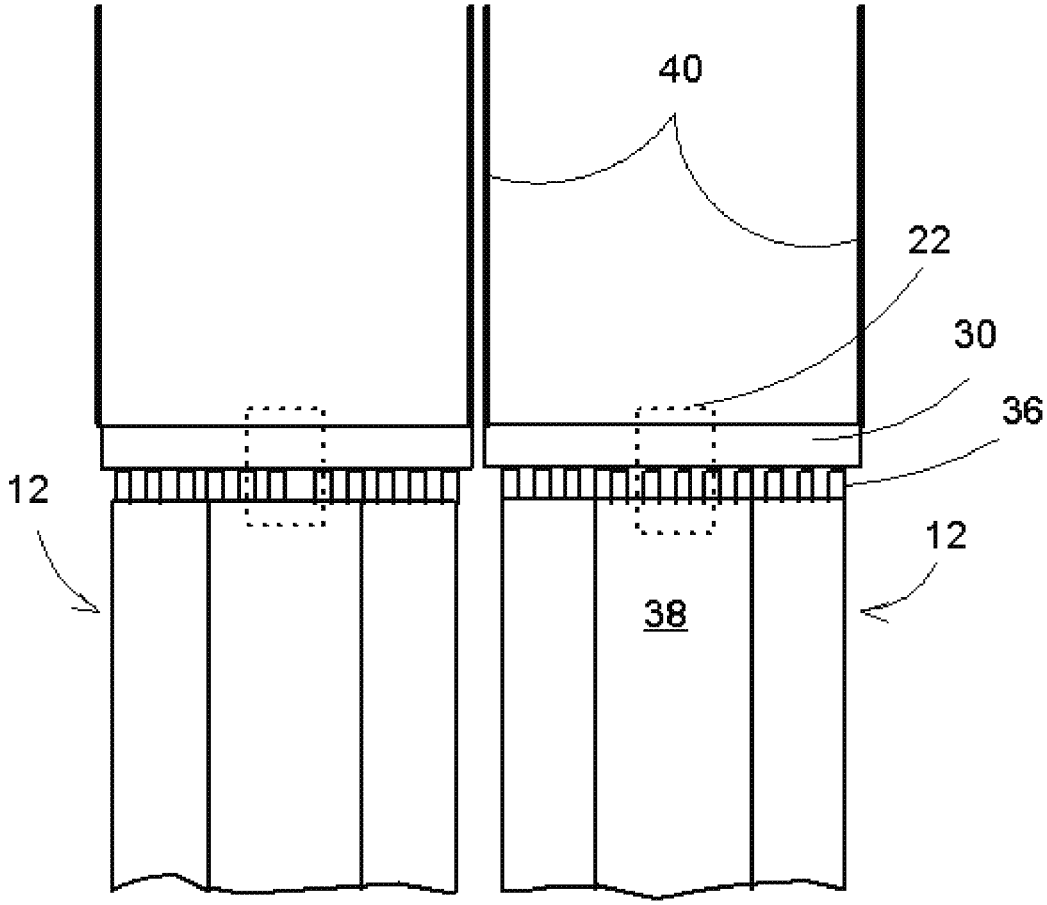
FIG. 5 illustrates a side view of a separator construction in accordance with FIG. 4.

FIGS. 4 and 5 thus disclose an arrangement in accordance with a preferred embodiment of the invention for suspending the separators 12 to the supporting structures above (illustrated schematically in FIG. 1 in connection with the prior art) so that the separators 12 are supported substantially throughout the whole length of their circumference, and that it is possible to monitor, with sufficient accuracy, the weight of an individual separator 12. FIG. 4 shows a frame 30 that is used in the supporting of the separators 12 and, FIG. 5, two adjacent separators 12 suspended by means of frames 30 in accordance with the invention.

It is a characteristic feature of an embodiment in accordance with the invention that the support structure of each separator 12 is formed of a frame 30 at least partially corresponding to the cross-sectional form of the separator 12. The frame 30 is independently suspended and located above the separator 12 substantially to the ceiling or supporting level of the furnace. In other words, both the furnace 10 and the separators 12 can now, in the embodiment in accordance with the invention, be suspended by suspending means of equal length to the supporting structure. According to the embodiment of FIG. 4, the frame 30 consists of a substantially square main frame 32, inside of which four beams 34 'rounding' the corners of the square have been arranged. The beams 34 form the interior of the frame 30 to be octagonal corresponding to the cross-sectional form of the separator 12 illustrated in FIG. 2. Naturally, if the separator 12 is, for example, hexagonal, the corners of the main frame 32 should be 'rounded' in a different way to result in a hexagonal frame. A large number of suspending means 36 have been arranged to hang downwards from the frame 30 of the octagonal inner circumference, the suspending means 36 being attached to the upper circumferential edge of the panel 38 of the separator 12. If the separator 12 is formed of water/steam tube wall 38, the suspending means 36 are attached, preferably, to the wall portion between the water/steam tubes. Suspending means 36 may be arranged, for example, at every second space between the water tubes. In the above arrangement, a method has also been mentioned in which the separator 12 is suspended at intervals of 400 mm in the circumference of the separator 12. In other words, it is essential that the separator 12 be suspended throughout the entire length of its circumference to the frame 30. The frame 30, in turn, is, in the embodiment of the drawing, suspended from its corners by four hanger rods or wires 40 to the supporting structure above. If it is desired to arrange, for measuring of the weight of the separator 12 in connection with the supporting, it is possible, for example, to provide one or more (preferably all) of the hanger rods or wires 40 of the frame 30 of each separator 12 with a strain gauge, or the like, measuring arrangement, reacting to the total mass of the separator 12.

Naturally, it is also possible to construct the frame 30 described above as a square, to correspond to the cross-sectional form of the separator 12 directly, in other words, for example, hexagonal or octagonal. The frame 30 can also be formed of two portions tightly connected to each other, the first portion corresponding to the cross section of the separator 12 of its circumference, and the second portion being formed to follow the requirements of the suspension as much as possible. Thus, for example, the first portion may be octagonal and the second portion may, for example, be formed of two beams, to which the first portion is attached. The supporting of the separator 12 may thus be preferably taken care of by means of hanger rods 40 arranged at the ends of the beams 34. The location of the above-mentioned beams 34 relative to the octagonal portion of the frame 30 is easily defined, for example, to follow the requirements of the primary steel structure. In other words, the beams 34 may be located, for example, at the ends of the circumferential portions parallel to the wall of the flue gas channel 16 of the octagonal portion, to the inclined portions of the circumference or parallel to the portions of the circumference, which are perpendicular to the direction of the flue gas channel 16. Naturally, it is possible to support the beams 34 not only to the first portion of the frame 30, but also, to each other, by one or more beams, preferably, parallel to the direction of the flue gas channel 16. These beams 34 can be located in principle in the same way as the previous beams. Correspondingly, the hanger rods 40 can be arranged either to the corners of the frame 30, as in the embodiment illustrated in FIGS. 4 and 5, or to the straight beam portions of the frame 30, for example, to the center parts thereof. The number of hanger rods or wires 40 need not be the same as the number of the corners in the frame 30, but, in practice, any reasonable amount applies.

FIG. 4 also discloses how the frame 30 is provided with a beam 42, to which an inlet conduit (a corresponding conduit is illustrated in FIGS. 1 and 2 of the prior art with reference number 14) is suspended with a corner portion 44 of the frame 30 by means of suspending means corresponding to suspending means 36 illustrated in FIG. 5. Preferably, the inlet conduit is substantially tangentially located to the separator 12, whereby the mixture of flue gases, ash and sand is brought to circulate along the inner surface of the separator 12. The inlet conduits may be arranged in the manner disclosed in FIG. 4 at the same place relative to each separator 12. It is, however, also possible, and, in some sense, even advantageous, to arrange the inlet conduits always in pairs in such a way that, for example, in the case of FIG. 4, the beam 42 in the left frame would be located in the upper right corner of the left frame as a mirror image of the beam 42 of the right frame. Naturally, the separators 12 connected to the frames there also were mirror images of each other.

The structure disclosed in FIGS. 4 and 5 also makes it possible to support the flue gas channel 16 to the above-described frames 30. Thereby, the flue gas channel 16 will be supported from below and the frame 30 will remain in the space between the flue gas channel 16 and the separator 12. The supporting of the flue gas channel 16 is carried out naturally by the same hanger rods 40 as the supporting of the separator 12. When defining the weight of the separator 12, it also contains part of the weight of the flue gas channel 16. This does not, however, have any particular significance, since, as a measurement result, the weight of the separator 12, together with the ash and sand therein, forms a clear majority of the total weight.

Further, there is an advantage gained with the use of a frame 30 in accordance with the invention. Now, the width of the flue gas channel 16 located above the separators 12 is not limited in practice in any way. If, for some reason, it is desired to have the separator 12 be wider, it is easily possible by extending the beams 34 of the frame 30 transverse to the flue gas channels 16 in such a way that the ends thereof extend outside the side surfaces of the channel 16. Thereby, by means of the hanger rods 40 attached to the ends of the beam 34, it is possible to suspend the separator 12 further to the primary steel structures. Thus, the frame 30, in accordance with the invention, renders it possible to make the boiler building lower, since it is possible to design the flue gas channels 16 having a low and rectangular cross section. In other words, the structure in accordance with the invention offers a possibility to define the size and shape of the flue gas channel 16 freely.

As becomes clear from the discussion above, a separator construction is provided, which is clearly more reliable than the separator constructions of the prior art, and is applicable for a number of various applications and processes. It is a characteristic of the separator construction that the separator may be suspended to the ceiling and suspending structure of the boiler building, in other words, to the so-called primary steel structure throughout the whole length of the circumference of the separator (in practice, at certain intervals), also in a situation where some fluidized bed boiler component is located between the separator and the suspending means in question, the component preventing the direct supporting of the separator from the wall surfaces.

It must be borne in mind that the discussion above merely discloses some preferred embodiments of the invention without a purpose to limit the invention from what is defined in the accompanying claims, which alone define the scope of the invention. Thus, it is, for example, clear that the embodiment in accordance with the invention may be applied to suspending separators of any cross-sectional form.

The invention claimed is:

1. A separator construction for receiving combustible material produced by a combustion process in a furnace of a fluidized bed boiler that is housed in a building having a ceiling and a supporting structure, the separator construction comprising:

(a) an inlet conduit that receives combustible material and exhaust gas from the furnace;

(b) a separator having a plurality of walls, each of the walls having an upper end, the separator receiving the combustible material and the exhaust gas from the inlet conduit, and separating the combustible material and the exhaust gas;

(c) an outlet conduit that receives the exhaust gas that is separated in the separator and that exhausts the separated exhaust gas, the outlet conduit being in flow communication with a flue gas channel that is located above the separator, the outlet conduit and the flue gas channel exhausting the separated exhaust gas; and (d) a suspension arrangement connecting the separator to the supporting structure in the building housing the boiler, the suspension arrangement having:

(i) a frame, arranged between the flue gas channel and the separator, (ii) a plurality of at least one of hanger rods and wires connecting the frame directly to the supporting structure, and (iii) suspending means connecting the upper ends of the walls of the separator to the frame, so that the frame supports the separator by the suspending means.

2. A separator construction in accordance with claim 1, wherein the frame is located substantially at an upper end of the furnace.

3. A separator construction in accordance with claim 1, wherein a shape of a perimeter of the frame corresponds to a shape formed by the upper ends of the walls of the separator.

4. A separator construction in accordance with claim 3, wherein the separator is octagonal in cross section.

5. A separator construction in accordance with claim 3, wherein the separator is hexagonal in cross section.

6. A separator construction in accordance with claim 1, wherein the frame includes a beam that suspends the inlet conduit.

7. A separator construction in accordance with claim 6, wherein the beam suspends the inlet conduit by the suspending means.

8. A separator construction in accordance with claim 1, wherein the frame supports the flue gas channel.

9. A separator construction in accordance with claim 8, wherein the flue gas channel is located substantially parallel to a side wall of the furnace.

10. A separator construction in accordance with claim 9, further comprising a plurality of separators to which the flue gas channel is connected.

11. A separator construction in accordance with claim 8, wherein a width of the flue gas channel is greater in size than the largest cross-sectional dimension of the separator.

12. A separator construction in accordance with claim 8, wherein a width of the flue gas channel is smaller in size than the largest cross-sectional dimension of the separator.

13. A separator construction in accordance with claim 1, wherein the separator returns the separates combustible material to the furnace.

* * * * *